United States Patent [19]

Lee

[11] Patent Number: 4,817,152

[45] Date of Patent: Mar. 28, 1989

[54] STEREO SYSTEM WITH PIEZO-ELECTRICAL FILM SPEAKER

[75] Inventor: Kye S. Lee, Suweon, Rep. of Korea

[73] Assignee: Samsung Electro-Mechanics Co., Ltd., Kyungki, Rep. of Korea

[21] Appl. No.: 103,174

[22] Filed: Sep. 30, 1987

[30] Foreign Application Priority Data

Sep. 30, 1986 [KR] Rep. of Korea ..... 86-8237[U]

[51] Int. Cl.[4] ..... H04R 5/02

[52] U.S. Cl. ..... 381/24; 381/111; 381/190

[58] Field of Search ..... 381/111, 116, 190, 191, 381/24

[56] References Cited

U.S. PATENT DOCUMENTS 4,515,997 5/1985 Stinger, Jr. ..... 381/190

*Primary Examiner*—Forester W. Isen

*Attorney, Agent, or Firm*—Michael N. Meller

[57] ABSTRACT

A stereo system produces stereo-phonic sound using a single piezo-electric film speaker. The arched film diaphragm of the speaker has one portion coupled to vibrate in response to a left stereo signal received by a first set of piezo-electric transducers and another portion coupled to vibrate in response to a right stereo signal received by a second set of piezo-electric transducers.

2 Claims, 1 Drawing Sheet

STEREO SYSTEM WITH PIEZO-ELECTRICAL FILM SPEAKER

FIELD OF THE INVENTION

The present invention relates to a stereo system utilizing a piezo-electrical element film speaker, particularly one in which different stereo signals are supplied to each of the two rows of electrical elements, the respective stereo signals being connected to respective edges of a film diaphragm, so as to obtain the effect of a stereo system while using only one speaker.

BACKGROUND OF THE INVENTION

A speaker is generally a device which transduces electric signals into sound signals. In particular, a dynamic speaker has a structure in which a voice coil, installed in a magnetic circuit, is displaced up and down in dependence on the electric signals supplied to it. The voice coil vibrates a mechanically connected diaphragm so as to reproduce sound signals. The dynamic speaker is widely used due to its simple structure, excellent reproduction characteristics and wide range of sound reproduction as well as high modulation effect. The dynamic speaker, on the other hand, also has some drawbacks: it is relatively large in size, it is very heavy in weight and its tone quality tends to be easily influenced by temperature or humidity.

Recently, continuous efforts have been made to develop a piezo-electrical film speaker, utilizing piezo-electrical elements to reciprocally transduce electrical energy and mechanical energy. Above all, a film speaker utilizing a number of piezo-electrical elements would enlarge the range of use for a piezo-electrical film speaker which has previously been used only as a speaker for high level sounds, so that it can become a substitute for dynamic speakers.

Compared with the former dynamic speaker, a film speaker possesses advantages attributable to its small size, light weight and low price. Consistently equal quality can be obtained independent of the humidity or temperature. Film speakers can also be used for ornamental purposes by being installed on a wall or desk and by being manufactured in various shapes such as a dome, arch, quadrilaterial, or cylinder.

In addition, a stereo type should be adopted for the speaker system in order to produce some vibrant stereophonic sound.

The conventional stereo system utilizing dynamic speakers, as shown in FIG. 1, comprises input terminal 1 which receives input electrical signals, a stereo separator 2 which separates the input signals, amplifiers 3, 3' which amplify each separate signal, and speakers 4, 4' which reproduce sound signals in dependence on the amplified electrical signals.

The separated signals, which have been separated into left and right stereo signals by the stereo separator 2, are amplified by respective amplifiers 3, 3' and finally are transmitted to the piezo-electrical element to operate the film diaphragm of the speaker.

SUMMARY OF THE INVENTION

Stereo systems of the forgoing type, however, have several disadvantages. In such systems it is necessary to energize at least two speakers by delivering separated left and right stereo signals to each speaker. In order to achieve the condition of desirable listening, listeners have to adjust the direction of both speakers in dependence on the distance of the listener from the speakers. In addition, these conventional systems occupy much space and are expensive.

In order to eliminate the aforementioned problems of the conventional speakers, the present invention provides a means for splitting the signal into separate stereo signals and then transmitting the stereo signals to respective rows of piezo-electrical vibrating elements in the film speaker. According to the invention, a stereo system with only one piezo-electrical film speaker is provided which enables the listener to enjoy stereo sound. In addition, equal right and left sound signals regardless of where he is positioned if the film diaphragm is formed in an arch shape.

DETAILED DESCRIPTION OF THE PREFERRED EMBODIMENT

Figure 1:
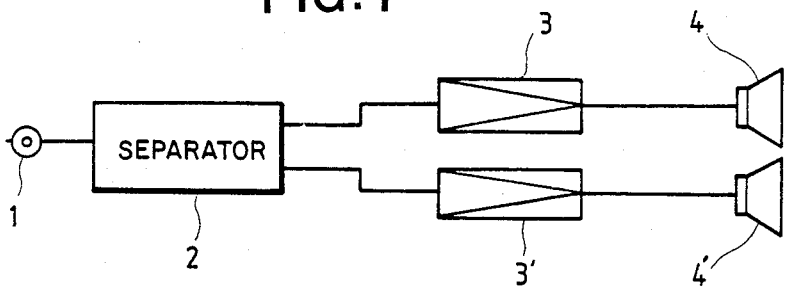
PRIOR ART FIG. 1
FIG. 1 is a block diagram of a prior art stereo system.
Figure 2:
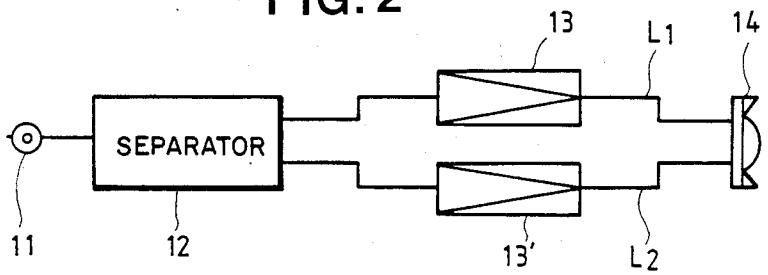
FIG. 2 is a block diagram of the stereo system according to the present invention.

The invention, as shown in FIG. 2, comprises an input terminal 11 which receives input electrical signals, a stereo separator 12 which separates the received electrical signals into left and right stereo signals, amplifiers 13, 13' which respectively amplify the separated stereo signals, and a piezo-electrical film speaker 14 which receives the amplified signals and reproduces sound signals.

The above piezo-electrical speaker 14 has a structure wherein a row of several piezo-electrical vibration elements is arrayed along each edge of the film diaphragm, each row of elements being connected in series to a respective one of said amplifiers 13, 13'. Such a piezo-electrical speaker is disclosed in co-pending U.S. patent application Ser. No. 097,028, the disclosure of which is incorporated herein by reference.

With this structure, the stereo system of the invention can produce stereophonic sound using only one speaker by supplying left stereo signals to the piezo-electrical vibration elements which are arrayed on the left side of the piezo-electrical film speaker and right stereo signals to the piezo-electrical vibration elements which are arrayed on the right side so as to energize the film diaphragm in accordance with each stereo signal.

The operation of the system in accordance with the invention is as follows. The input signals supplied to the input 11 are separated into left and right stereo signals by stereo separator 12.

After the separated signals have been respectively amplified by amplifiers 13, 13', the signals from the left amplifier 13 are supplied to the left row of the piezo-electrical elements through line L1, whereas the signals from the right amplifier 13' are supplied to the right row of the piezo-electrical elements through line L2, so that the signal diaphragm reproduces both left and right sound signals. In this respect, it is desirable that a film speaker use a square film diaphragm.

Figure 3:
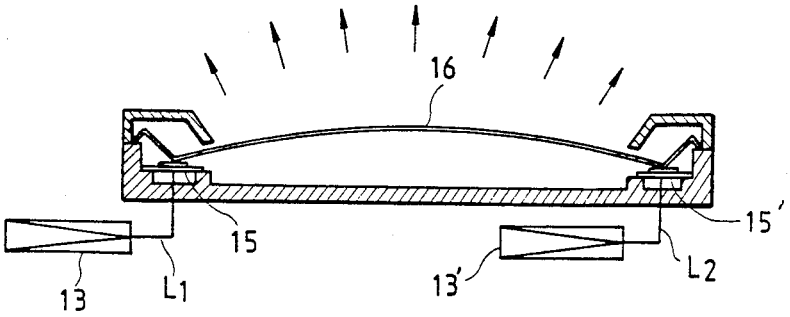
FIG. 3 is a sectional view of the piezo-electrical film speaker according to the present invention.

FIG. 3 illustrates a sectional view of the arch-shaped film diaphragm with piezo-electrical elements. A respective row of several piezo-electrical elements is arranged on each side of the frame, each piezo-electrical element being in contact with the film diaphragm. The film diaphragm is vibrated in dependence on the signals supplied by the piezo-electrical elements. The left stereo signals amplified by the left amplifier 13 are supplied through line L1 to the row of piezo-electrical elements 15 on the left side of the film speaker, while the right stereo signals amplified by the right ammplifier 13' are supplied through line L2 to the row of pizeo-electrical elements 15' on the right side of the film speaker. The left and right stereo signals energize the diaphragm 16.

According to the results of experimentation, in the case where one diaphragm 16 is energized by the piezo-electrical vibration elements of both rows, each of which is energized by different signals, the interface phenomenon among those signals is slight. On the contrary, stereophonic sound which has good directional characteristics can be heard. The stereo sound produced according to the invention has an equalized transmission throughout a wide angular range, as shown by the arrows in FIG. 3.

The invention can be applied to various forms of piezo-electrical film speakers with reduced cost and makes it possible to listen to stereophonic sound from only speaker without any additional control of the sound.

The stereo system in accordance with the invention produces excellent stereophonic sound regardless of the position of the listener due to the equalization of the directional characteristics throughout a wide range of the transmission angle.

What is claimed is:

1. A stereo system for producing stereo sound comprising:

a piezo-electric film speaker having first and second rows of piezo-electric vibrating elements and a film diaphragm having a portion of arched cross section, said piezo-electric elements of said first row being coupled to a first edge of said arch of said film diaphragm and said piezo-electric elements of said second row being coupled to a second edge of said arch of said film diaphragm;

(b) first and second amplifiers, each amplifier having an input terminal and an output terminal, said output terminal of said first amplifier being electrically connected to said first row of piezo-electric elements and said output terminal of said second amplifier being electrically connected to said second row of piezo-electric elements; and (c) a signal separation means having an input terminal and first and second output terminals, said first output terminal of said signal separation means being electrically connected to said input terminal of said first amplifier and said second output terminal of said signal separation means being electrically connected to said input terminal of said second amplifier, wherein said signal separation means separates a signal received at its input terminal into a first stereo signal and a second stereo signal, said first stereo signal being different than said second stereo signal, said first signal being supplied to said first amplifier and said second signal being supplied to said second amplifier, and wherein said first edge of said arch of said film diaphragm vibrates in response to receipt of said amplified first signal by said first row of piezo-electric elements and said second edge of said arch of said film diaphragm vibrates in response to receipt of said amplified second signal by said second row of piezo-electric elements.

2. A stereo system comprising an input terminal, means for separating a signal received at said input terminal into first and second stereo signals, said first stereo signal being different than said second stereo signal, first and second amplifying means for respectively amplifying said first and second stereo signals, and a piezo-electric film speaker having first and second input terminals connected to respectively receive said amplifier first and second stereo signals, wherein said film speaker comprises an arched film diaphragm having first and second portions, said first portion being coupled to said first input terminal by first piezo-electric transducing means and said second portion being coupled to said second input terminal by second piezo-electric transducing means.

* * * * *